US009533777B2

(12) United States Patent
De Marco

(10) Patent No.: US 9,533,777 B2
(45) Date of Patent: Jan. 3, 2017

(54) ASCEPTIC DISPENSER

(75) Inventor: Emiliano De Marco, Loncin (BE)

(73) Assignee: GE HEALTHCARE LIMITED, Buckinghamshire (GB)

( * ) Notice: Subject to any disclaimer, the term of this patent is extended or adjusted under 35 U.S.C. 154(b) by 548 days.

(21) Appl. No.: 13/882,540

(22) PCT Filed: Nov. 1, 2011

(86) PCT No.: PCT/US2011/058733

§ 371 (c)(1),
(2), (4) Date: Apr. 30, 2013

(87) PCT Pub. No.: WO2012/061353

PCT Pub. Date: May 10, 2012

(65) Prior Publication Data

US 2013/0220484 A1 Aug. 29, 2013

Related U.S. Application Data

(63) Continuation-in-part of application No. PCT/US2011/058733, filed on Nov. 1, 2011.

(60) Provisional application No. 61/408,871, filed on Nov. 1, 2010.

(51) Int. Cl.

| | |
|---|---|
| ***B65B 1/04*** | (2006.01) |
| ***B65B 3/00*** | (2006.01) |
| ***A61J 1/06*** | (2006.01) |
| ***A61J 1/14*** | (2006.01) |
| ***A61J 1/20*** | (2006.01) |
| *B65B 55/02* | (2006.01) |

(52) U.S. Cl.

CPC ..... *B65B 3/003* (2013.01); *A61J 1/06* (2013.01); *A61J 1/1412* (2013.01); *A61J 1/2037* (2015.05); *A61J 1/2075* (2015.05); *A61J 1/2082* (2015.05); *A61J 1/2096* (2013.01); *B65B 55/02* (2013.01)

(58) Field of Classification Search

CPC ..... B65B 3/003; A61J 1/1412; A61J 1/2037; A61J 1/2075; A61J 1/2082; A61J 1/2096

USPC ..... 141/329, 236, 237, 242, 244; 604/406, 604/411

See application file for complete search history.

(56) References Cited

U.S. PATENT DOCUMENTS

| | | | | |
|---|---|---|---|---|
| 4,568,345 | A * | 2/1986 | Keilman et al. | 604/403 |
| 5,423,751 | A * | 6/1995 | Harrison et al. | 604/83 |
| 2003/0230521 | A1 * | 12/2003 | Schick | 210/110 |
| 2005/0015075 | A1 | 1/2005 | Wright et al. | |

(Continued)

FOREIGN PATENT DOCUMENTS

| | | | |
|---|---|---|---|
| EP | 2179926 | A1 | 4/2010 |
| JP | 2007-504850 | A | 3/2007 |

(Continued)

OTHER PUBLICATIONS

PCT/US2011/058733 ISRWO Dated Feb. 16, 2012.

(Continued)

*Primary Examiner* — Jason K Niesz

(57) ABSTRACT

A sterile dispense system provides for transfer of a fluid from a disposable fluid-path to a vial without needles piercing the vial stopper, for disconnecting the vial from the disposable fluid-path while keeping integrity of the solution filled into the vial and to enable withdrawing of the solution from the vial. The pressure valve and luer valve are provided in serial connection to a fluid vial to enable clean filling and dispensing from the vial.

15 Claims, 4 Drawing Sheets

(56) References Cited

U.S. PATENT DOCUMENTS

| | | | | |
|---|---|---|---|---|
| 2005/0173021 | A1 | 8/2005 | Muto et al. | |
| 2006/0058734 | A1* | 3/2006 | Phillips | 604/93.01 |
| 2007/0032775 | A1* | 2/2007 | Niedospial et al. | 604/415 |
| 2009/0255590 | A1* | 10/2009 | Enerson | 137/15.18 |
| 2009/0306621 | A1 | 12/2009 | Thome, Jr. et al. | |
| 2011/0094619 | A1 | 4/2011 | Steel et al. | |

FOREIGN PATENT DOCUMENTS

| | | | |
|---|---|---|---|
| JP | 2008-253356 | A | 10/2008 |
| JP | 2009-165854 | A | 7/2009 |
| JP | 2011-525142 | A | 9/2011 |
| WO | 2005/004974 | A1 | 1/2005 |
| WO | 2008048776 | A2 | 4/2008 |
| WO | 2009100428 | A1 | 8/2009 |
| WO | 2009143116 | A2 | 11/2009 |

OTHER PUBLICATIONS

Chinese Office action and Search report from corresponding Chinese application No. 201180052995 mailed Dec. 15, 2014; 8 pages.
Japanese Office Action regarding Japanese Application No. 2013-536919, mail date Oct. 8, 2015, with English language translation, 10 pages.
European Search Report and Written Opinion issued in connection with corresponding EP Application No. 11838659.8-1708 dated Aug. 14, 2015.

* cited by examiner

ASCEPTIC DISPENSER

FIELD OF THE INVENTION

The present invention is related to radiopharmaceutical dispense equipment. More specifically, the present invention is directed to an asceptic dispenser.

BACKGROUND OF THE INVENTION

For most dispensing solutions of a Positron Emission Tomography (PET) tracer, a bulk tracer solution needs to be divided into several fractions. Such dispensing needs to be done under aseptic conditions, typically Class A clean room with class B background. The operations for these PET tracers, as the tracers are radioactive, are desirably conducted in a fully-automated manner within shielded cells.

Most PET tracer manufacturing sites have limited number of hot-cells with class A clean room environment. Therefore a means enabling aseptic filling in class C environment would expand the potential PET production sites that could produce the tracers. Additionally, enabling any PET tracer manufacturing site to dispense in aseptic condition within a clean room class C may be the basis for a new dispenser to be provided to a wider market (beyond tracer production centers having clean room dispensing facilities).

WO2009/100428 discloses a way to dispense aseptically fluids in a closed sterile disposable fluid path (called disposable kit) allowing thus this operation to be performed in a clean room class C whilst dispensing is usually performed in clean room class A environment. Within the disposable kit, the connection between the closed sterile vial and the fluid path is ensured by a needle piercing the vial stopper.

A pre-piercing of the stopper during assembly of the disposable kit in the factory may not be an appropriate solution for sterile connection. Aging of the assembly between the time the kit was assembled and the time it is used for dispensing may lead to leaks at the piercing holes, thus compromising sterility of the connection.

There is therefore a need in the art for a needle-less asceptic dispenser which obviates the risks of accidental needle sticks to operators. There is also a need in the art for a means of connecting the dispense vial to the dispense cassette while both are still within a container or bag maintaining a sterile environment for the surfaces which will conduct a pharmaceutical product.

DETAILED DESCRIPTION OF THE PREFERRED EMBODIMENTS

Figure 1:
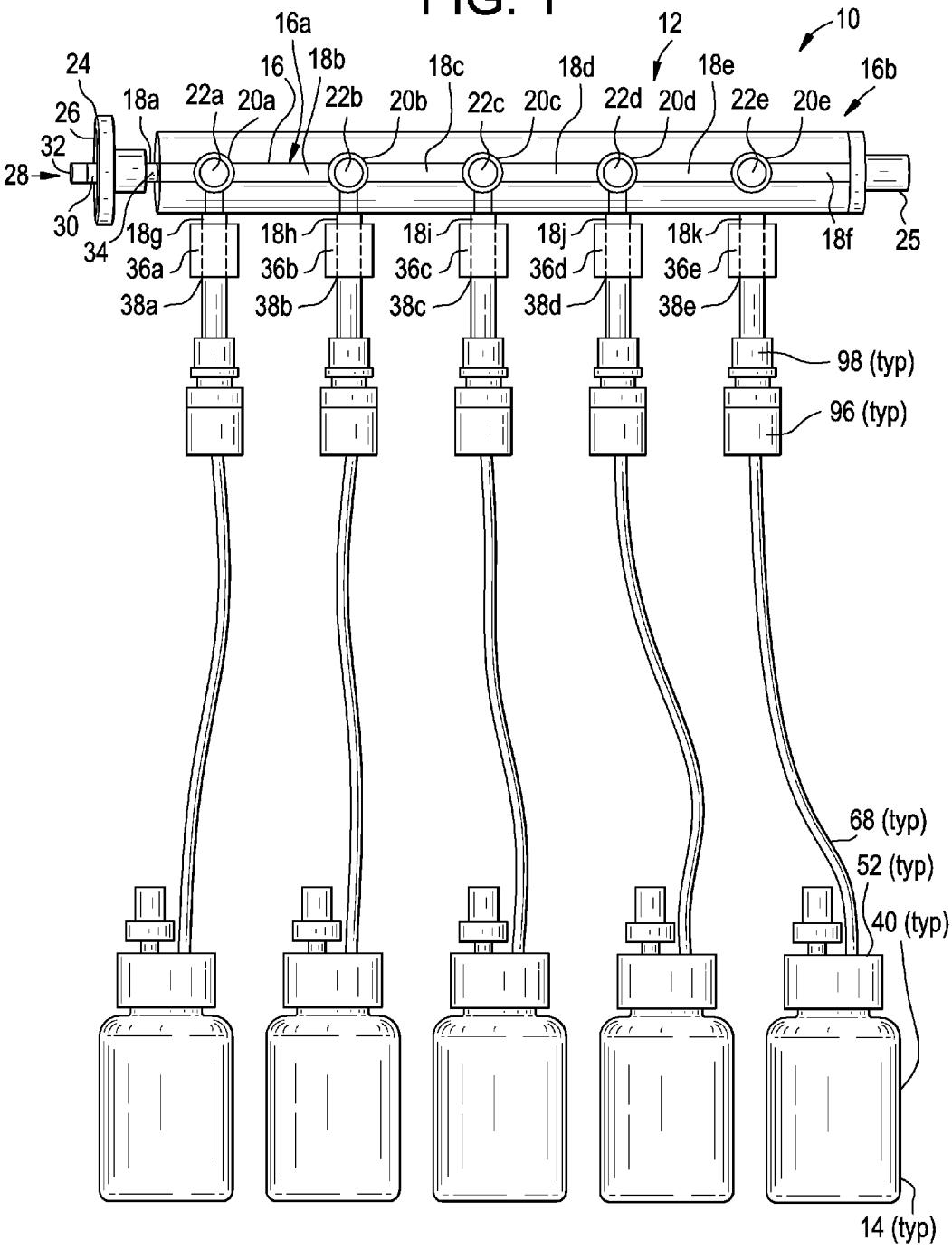
FIG. 1 depicts a dispense cassette assembly of the present invention.
Figure 2:
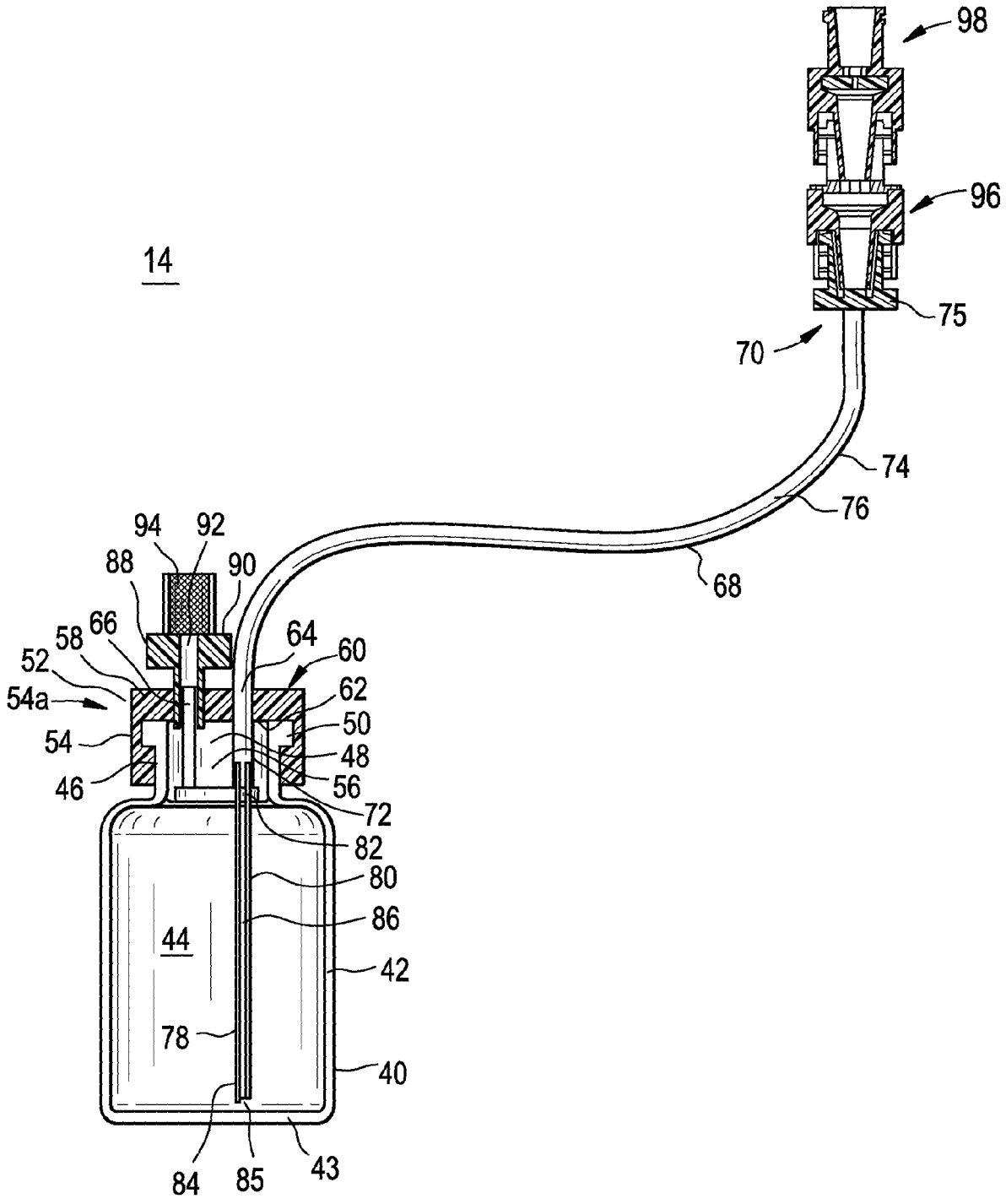
FIG. 2 depicts a cross-sectional view of a dispense vial of the present invention connected to a pressure valve of a dispense cassette of the present invention.

This present invention proposes a way to transfer a fluid from a disposable fluid-path to a vial without needles piercing the vial stopper, to disconnect the vial from the disposable fluid-path while keeping integrity of the solution filled into the vial and to enable withdrawing of the solution from the vial.

The present invention provides a means to connect a closed sterile vial to a sterile disposable fluid-path (e.g. tubes) in a way enabling aseptic filling of a drug product into the vial while maintaining integrity of the drug product once the vial is disconnected from the fluidpath.

The present invention provides

1. A vial sealed by an elastomeric stopper.
2. A vent filter (0.22 μm) having an elongate needle body extending through the stopper to let air escape from the stopper while protecting against external contamination.
3. A fill/withdrawal needle extending down to the bottom of the vial to fill the vial and later remove the liquid with limited loss.
4. A luer activated valve (valve open if a luer connector is inserted) to close the vial inlet/outlet once the vial is disconnected from the fluidpath upstream.
5. A pressure activated valve (valve open if there is pressure) to protect the luer activated valve during transportation after disconnection from the fluidpath.

There is typically a 0.22 μm filter in the fluidpath upstream of the device to remove potential microbiological contaminants from the solution before filling of the vials.

Both valves, the luer activated valve and pressure activated valve, are commercially available.

In the present invention, the vial with its cap and valves is part of a disposable fluid-path used to dilute a PET tracer solution, filter the solution through a 0.22 μm media and split the solution for filling into several vials. The whole fluidpath including the vial with its connection is assembled in clean room, packed and sterilized. The packaged fluidpath is maintained sterile in its packaging.

During the vial filling process the liquid (filtered upstream by means of a 0.2 μm filter) flows through the pressure activated valve, the luer activated valve and the inlet tube, into the vial. Air can escape from the vial through the 0.2 μm vent filter protecting the vial from external contamination.

After filling possess there is no more pressure in the fluid-path. Thus the pressure activated valve closes, protecting the solution within the vial from contamination. At this point the pressure activated valve, while still connected to the luer-activated valve and the vial downstream of the valve, can be disconnected from the fluid-path without compromising sterility of the solution contained in the vial.

Once disconnected, the vial (equipped with the luer activated valve and the pressure activated valve) can be transported to another location (e.g. the hospital where the solution will be used for human injection). At the hospital the vial is transferred into a laminar flow hood. At this point the pressure activated valve can be removed from the luer activated valve without compromising sterility of the internal part of the luer activated valve. This operation will close the activated valve protecting the solution contained in the vial from contamination.

To remove the solution from the vial a syringe can be connected to the luer activated valve. As the fluidpath is opened through the luer from the syringe, the operator can withdraw solution from the vial into a syringe.

The whole kit is assembled, placed in a blister tray suitable for sterile packaging, sealed in appropriate clean room class and then sterilized (e.g. typically sterilization through gamma irradiation but other sterilization means may also be used). The whole fluidpath is a closed system as all inlets/outlets are protected against microbiological contamination by the 0.2 filter. After disconnection from the fluidpath the integrity of the solution filled into the vials is maintained by means of the two serial valves of the device.

Referring now to FIGS. 1, 2 and 4-8, the present invention provides a dispense cassette assembly 10 having a dispense cassette manifold 12 supporting a plurality of dispense vials 14 of the present invention. Dispense cassette assembly 10 is desirably formed from polymeric materials which are suitable for radiopharmaceutical applications. It is further contemplated that dispense cassette assembly 10 may be provided in a sealed container which maintains the sterility thereof. Desirably, dispense cassette assembly 10 will be sterilized to a suitable standard, such as class 100 or class A, then placed in and sealed within the container in an environment and manner which maintains the desired sterility level of assembly 10 as a whole and vials 14 individually.

Manifold 12 includes an elongate manifold body 16 which defines an elongate fluid flowpath 18, comprised of axially-aligned flowpath segments 18*a-f* and transverse segments 18*g-k*, therethrough. Manifold body 16 also defines a number of valve sockets 20*a-e* for receiving valve members 22*a-e*, respectively. Each valve socket is in fluid communication with pairs of adjacent co-axial flowpath segments as well as with a single transverse flowpath segment. Valve members 22*a-e* are rotatable within valve sockets 20*a-e*, respectively, and define valve flowpath therethrough so as to selectably establish fluid communication between adjacent co-axial flowpath segments and/or a transverse flowpath segment opening into the same valve socket. Typically, the vials 14 will be serially filled by adjusting valve members 22*a-e* to direct fluid into a single vial at a time.

Manifold body 16 supports a filter element 24 at a first end 16*a* and a plug 25 at a second end 16*b* thereof. Filter element 24 includes a filter housing 26 defining a filter passageway 28 therethrough and a filter media 30 positioned across passageway 28. Filter housing defines opposing input port 32 and output port 34 in fluid communication with passageway 28 on opposing sides of filter media 30. Output port 34 is placed in fluid communication with fluid flowpath 18 at the first end 16*a* of manifold body 16. Plug 25 seals fluid flowpath 18 at segment 18*f*. In one embodiment, the present invention contemplates that plug 25 may be removed from manifold body 16 so as to allow a conduit to be connected thereto for further conducting fluid to another destination, such as another vial or a second manifold body for dispensing to still more vials.

Connector means 36*a-e* are attached to manifold body 16 at the far end of each of the transverse segments 18*g-k*, that is, the end opposite from the valve sockets 20*a-e*. Each of the connector means 36*a-e* define a connector flowpath 38*a-e*, respectively, therethrough so as to be in fluid communication with its associated transverse segment 18*g-k*, respectively. The connector means 36*a-e* provide for disconnectable fluid-tight mating with a vial 14 of the present invention. After the dispensing operations, each of the attached vials 14 may be disconnected from manifold 12 at its associated connector means 36.

Each vial 14 includes a vial container 40 having an open-ended container wall 42 defining a vial cavity 44. Container 40 further includes an annular neck 46 defining a vial aperture 48 in fluid communication with cavity 44. Neck 46 also includes an outwardly-extending annular rim 50. A vial cap 52 is affixed to neck 46 so as to span vial aperture 48. Vial cap 52 includes a cylindrical cap wall 54 defining a cap cavity 56 and a transverse cap cover 58 spanning one end 54*a* of cap wall 54. Cap cover 58 includes opposed major planar surfaces 60 and 62. Cap cover 58 also defines a product passageway 64 and a vent passageway 66 therethrough, each passageway opening on surfaces 60 and 62.

Vial 14 also includes an elongate fluid conduit 68 having a first open end 70, a second open end 72, and an elongate flexible cylindrical conduit body 74 extending therebetween. Conduit body 70 defines an elongate flowpath 76 extending in fluid communication between open ends 70 and 72. First open end 70 is affixed to an annular connector collar 75, while second open end 72 extends through product passageway 64 in sealed engagement with cap cover 58. Additionally, second open end 72 desirably supports an elongate rigid cannula 78 therein. Cannula 78 includes an elongate cannula body 80 having opposed first and second open ends 82 and 84, respectively, and defining an elongate cannula passageway 86 extending in fluid communication therebetween. Cavity 44 is thus in open fluid communication with first open end 70 of conduit 68. Second end 84 of cannula body 80 desirably extends to the base 43 of vial wall 42, desirably still to the lowest elevation thereof to maximize fluid withdrawal. The present invention contemplates that second open end 84 of cannula body 80 includes a bevelled edge 85 to ensure that base 43 does not plug open end 84. Alternatively stated, the second open end 84 of cannula body 80 is tapered differently from base 43 so that cavity 44 remains in fluid communication with cannula passageway 86.

Vial 14 supports a gas vent 88 in sealed registry with vent passage 66. Vent 88 includes a vent body 90 defining an elongate vent flowpath 92. Vent body 90 is joined to cap cover 58 so as to place flowpath 92 in fluid communication with cavity 44. Additionally, vent body 90 supports a filter media 94 across flowpath 92 so as to provide filtered fluid communication between cavity 44 and the outside environment. Filter media 94 is desirably a 0.22 μm filter (mean pore size) to let air escape from cavity 44 while protecting against external contamination reaching cavity 44.

Vial 14 further includes a luer-activated valve 96 and a pressure-activated valve 98 serially connected to first end 70 of conduit 68. First end 70 of conduit 68 is sealingly affixed to luer-activated valve 96 at one end and pressure-activated valve 98 is removably attached to luer-activated valve 96 at the opposed end. Pressure-activated valve 98 is removably attached to a connector means 36*a-e* of manifold 12. Luer-activated valve 96 is put in an open position when pressure-activated valve 98 is attached to it, and a closed position when pressure-activated valve 98 is disconnected from it. Pressure-activated valve is biased to a normally-closed position, opening under fluid pressure from manifold 12. Thus, when a controller causes a pump to stop directing fluid into vial 14, pressure-activated valve 98 will move to a closed position, sealing cavity 44. Thus, pressure-activated valve 98 may be disconnected from its attached connector means of manifold body 12 while still protecting the contents of vial 14 from exposure to the environment outside thereof. Additionally, when pressure-activated valve 98 is disconnected from luer-activated valve 96, luer-activated valve 96 will be in a closed configuration which continues to protect the contents of vial 14 from exposure to contaminants. A needle-less syringe may then be connected to luer-activated valve to again open the valve and allow the contents in cavity 44 to be removed therefrom and into the attached syringe. Alternatively, a syringe supporting a needle may be connected to luer activated valve 96 so as that the needle punctures an elastomeric stopper of luer-activated valve 96, also allowing the contents of vial 14 to be withdrawn without exposing the same to contamination.

Figure 3:
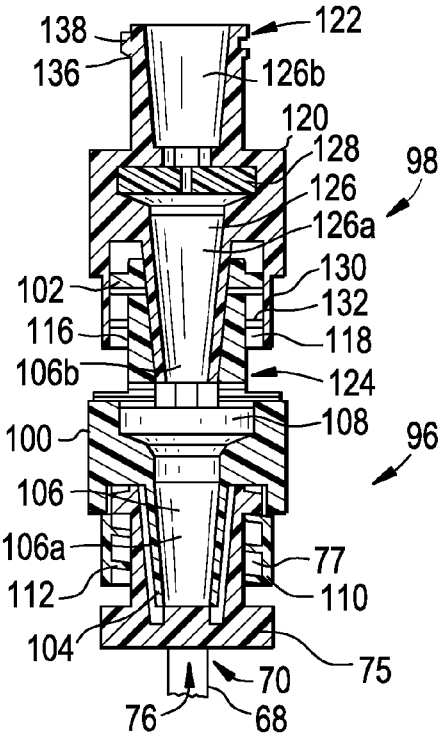
FIG. 3 depicts a cross-sectional view of the luer connection member mated with a pressure valve of a dispense cassette of the present invention.
Figure 4:
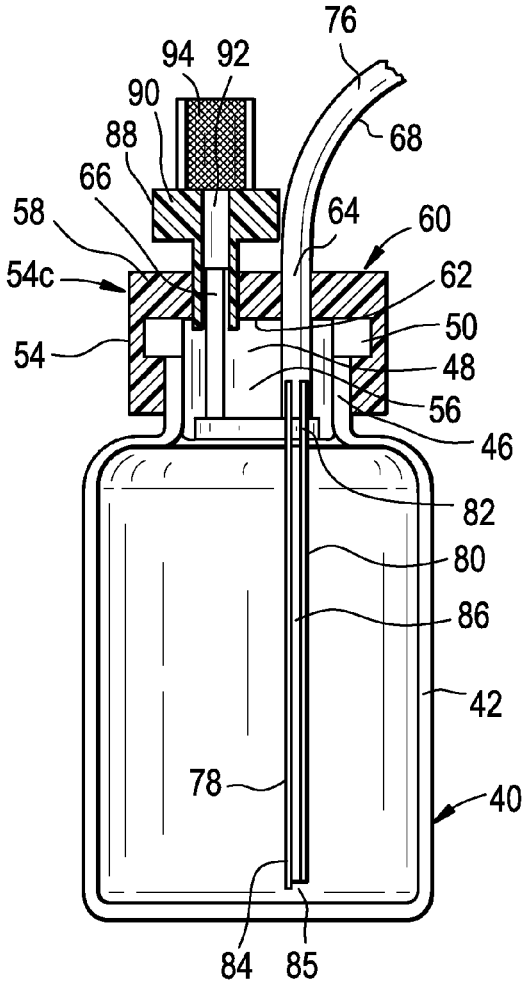
FIG. 4 depicts a cross-sectional view of the connector cap and dispense vial of the present invention.
Figure 5:
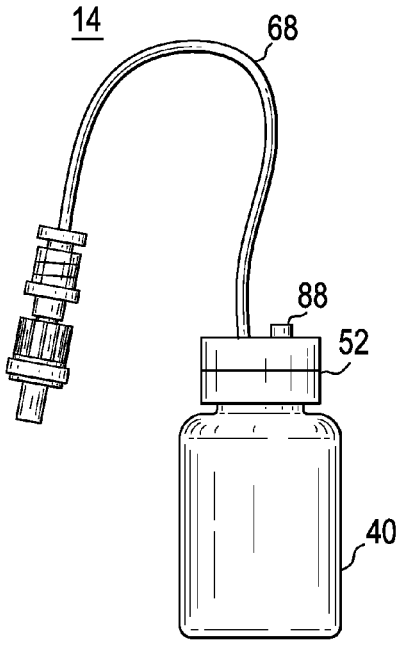
FIG. 5 depicts a side elevation view of a dispense vial of the present invention connected to a pressure valve of a dispense cassette of the present invention.
Figure 6:
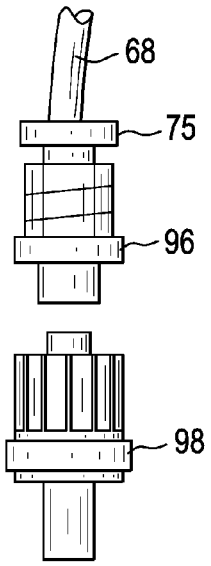
FIG. 6 depicts the luer connector of the connector vial of the present invention separated from the pressure valve used by the dispense cassette of the present invention.
Figure 7:
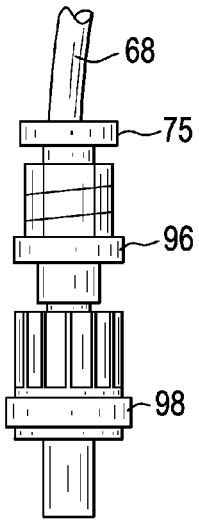
FIG. 7 depicts the luer connector of the connector vial of the present invention mated to the pressure valve used by the dispense cassette of the present invention.
Figure 8:
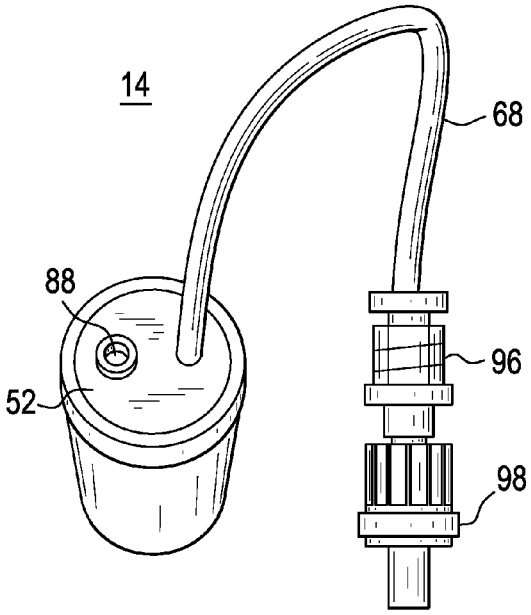
FIG. 8 depicts a top elevation view of a dispense vial of the present invention connected to a pressure valve of a dispense cassette of the present invention.

With additional reference to FIG. 3, luer-activated valve 96 includes a valve body 100 having a first open end 102, a second open end 104 and defining a luer valve passageway 106 extending in fluid communication therebetween. An elastomeric stopper 108 is supported in valve body 100 across passageway 106 and is urgeable between a closed position sealing passageway 106 and an open position providing fluid communication between opposed open ends 102 and 104. Passageway 106 is thus divided into a proximal passageway 106*a* in open fluid communication with conduit flowpath 76 and a distal passageway 106*b* on the opposite side of stopper 108 from proximal passageway 106*a*. Second end 104 of valve body 100 includes a female engagement means 110 including an inwardly-facing thread 112 for engaging the external thread 77 of connector collar 75 and thus affixing valve body 100 to conduit 68. First end 102 of valve body 100 includes a male engagement means 116, supporting an external thread 118 for engaging a female connection of pressure-activated valve 98.

A luer-activated valve, sold as "Luer Activated Valve with Female Luer and Male Luer" by Supplier: QOSINA, Part #: 80114, has been employed in the present invention. For further description of this valve, see Luer Activated Device with Compressible Valve Element, International Patent Application No.: PCT/US2007/080166-WO/2008/048776, the entire contents of which are hereby incorporated by reference herein as if fully disclosed herein.

Pressure-activated valve 98 includes a valve body 120 having a first open end 122, a second open end 124 and defining a pressure valve passageway 126 extending in fluid communication therebetween. An elastomeric stopper 128 is supported in valve body 120 across passageway 126 and is urgeable between a closed position sealing passageway 126 and an open position providing fluid communication between opposed open ends 122 and 124. Passageway 126 is thus divided into a proximal passageway 126*a* in open fluid communication with distal passageway 106*b* of luer-activated valve 96 and a distal passageway 126*b* on the opposite side of stopper 128 from proximal passageway 126*a*. Second end 124 of valve body 120 includes a female engagement means 130 including an inwardly-facing thread 132 for engaging the external thread 118 of luer-activated valve 96 and thus affixing valve body 120 to valve 96. First end 122 of valve body 120 includes a male engagement means 136, supporting an external thread 138 for engaging a female connection of connector means 36.

A pressure-activated valve, sold as "Pressure Activated Valve with Female Inlet and Male Outlet", sold by Supplier: "QOSINA, Part #: 80107, has been employed in the present invention. Additionally, see Pressure Activated Valve", International Patent Application No.: PCT/US2009/044468, published as WO/2009/143116, the entire contents of which are hereby incorporated by reference herein as if fully disclosed herein.

In operation, stopper 108 of luer-activated valve 96 is urged between the open and closed position by second end 124 of pressure-activated valve 98. When valve 98 is connected to valve 96, second end 124 of valve body 120 engages stopper 108 and urges it into the open position, thereby allowing fluid communication between passageways 106*a* and 106*b*. When valve 98 is disconnected from valve 96, the disengagement of second end 124 with stopper 108 causes the stopper to deflect back into the closed position, thereby isolating cavity 33 of vial 14. Similarly, stopper 128 of valve 98 is urged from the closed to the open position by fluid pressure acting thereon. The fluid pressure is the result of a pump forcing a product liquid through manifold 12 and against stopper 128. Stopper 128 will then move into the open position and allow the product liquid to flow therepast. As valve 98 is connected to valve 96, valve 96 will be in the open position also, allowing the product liquid to flow past stopper 108, through conduit flowpath 76 and cannula passageway 86 into cavity 44. The flow of a product liquid into cavity 44 will displace air within cavity 44 out through gas vent 88. Gas vent 88 will prevent the product liquid from flowing therethrough. When dispensing is conducted under a laminar flow hood, there will be no risk of contaminated air-flow back through vent 88 into cavity 44.

Therefore, cassette assembly 10 may be assembled in a clean environment and sterilized, providing that all liquid contacting surfaces are sufficiently sterilized. Cassette assembly 10 may then be sealed within a container or bag in a clean environment, such as Class A, so that cassette sterility is maintained. Cassette assembly 10 may then be shipped to outside users who may open the container or bag and remove cassette assembly 10 therefrom for connection to a dispensing device which provides a product fluid through filter element 24 into flowpath segment 18*a*. Manipulation of valve members 22*a-e* can direct the product liquid through one or more of the transverse flowpath segments 18*g-k* and into an attached vial 14.

Once dispensing is complete, each vial 14 may be disconnected from the connector means 36 to which it is attached. The pressure-activated valve 98 will seal passageway segment 126*a* from exposure to the environment, thereby protecting the liquid contents of cavity 44. Vial 14 may then be transported to another location where an operator may remove valve 98 from vial 14. As valve 98 is removed, stopper 108 of luer-activated valve will be urged to a closed position to still protect the product liquid in cavity 44 from contamination. Withdrawal of fluid from cavity 44 may be accomplished as previously described.

While the particular embodiment of the present invention has been shown and described, it will be obvious to those skilled in the art that changes and modifications may be made without departing from the teachings of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A vial assembly for a dispensing system, comprising:

a vial container having a container body defining a vial aperture and a vial cavity in fluid communication therewith;

a cap having a cap body affixed across said vial aperture so as to enclose said vial cavity, said cap body defining a gas filter aperture through said cap body, said filter aperture supporting a gas filter media therein, said cap body further defining a product passageway therethrough, said cap further comprising:

an elongate conduit including an elongate conduit body defining opposed first and second open ends and an elongate conduit passageway extending in fluid communication therebetween, said second open end of said conduit extending through said product passageway of said cap and in sealed engagement with said cap body, a first valve member supported at the first end of said conduit; and a second valve member removably attached to said first valve member at an opposing end of said first valve member, wherein said second valve member is pressure-activated and biased to a normally-closed position and open under fluid pressure, said first and second valve member are adjustable between a first orientation in which the first valve member is in a closed position ensuring fluid isolation of said vial cavity and a second orientation in which the first valve member is in an open position to place said vial cavity in open fluid communication with an inlet port of said second valve member.

2. A vial assembly of claim 1, wherein said first valve member is a luer valve.

3. A vial assembly of claim 1, wherein said second end of said conduit supports an elongate rigid cannula extending through said vial cavity.

4. A vial assembly of claim 1, wherein said vial cavity and said conduit passageway are sterile environments.

5. A vial assembly of claim 4, wherein said sterile environment meets one of Class A and Class 100 levels.

6. A dispense cassette for dispensing a fluid, comprising:

a manifold comprising an elongate manifold body which defines an elongate fluid flowpath therethrough, wherein said flowpath further comprises axially-aligned flowpath segments and transverse segments, therethrough, said manifold body defining a plurality of valve sockets for receiving valve members, respectively, such that each valve socket is in fluid communication with pairs of adjacent co-axial flowpath segments as well as with a single transverse flowpath segment, said manifold further comprising a valve member rotatably seated within each valve socket, each said valve member defining a valve flowpath therethrough so as to selectably establish fluid communication between one co-axial flowpath segment and one of an opposed co-axial flowpath segment and a transverse flowpath segment;

a connector member for each transverse segment, each connector member defining a respective connector flowpath therethrough in fluid communication with its respective transverse segment, wherein each connector member is disconnectably connected to a respective vial assembly of claim 1.

7. A dispense cassette of claim 6, wherein said manifold body supports a filter cartridge at an inlet port thereof so as to provide filtered fluid isolation of said fluid flowpath.

8. A dispense cassette of claim 6, further comprising a pump mechanism for directing fluid from a source through said filter cartridge into said flowpath.

9. A dispense cassette of claim 6, wherein said manifold flowpath is a sterile environment.

10. A dispense cassette of claim 9, wherein said manifold flowpath meets a sterility level of one of Class A and Class 100.

11. A kit for dispensing a fluid, said kit comprising:

a sealed container having a container wall defining a container cavity;

a dispense cassette of claim 6 positioned within said container cavity;

wherein said container and said dispense cassette are adapted to allow an operator to switch the first valve member and the second valve member of each vial assembly within the container cavity between a first orientation in which the first valve member is in a closed position ensuring fluid isolation of said container cavity and second orientation in which the first valve member is in an open position to place said container cavity in open fluid communication with an inlet port of said second valve member.

12. A dispense cassette for dispensing a fluid, comprising:

a cassette manifold comprising:

a manifold body defining at least one valve socket;

a valve body positioned within said valve socket, said valve body defining a valve passage extending therethrough;

said manifold body defining an input port, and at least one output port, such that said valve body is positionable within said valve socket to place said input port in selectable fluid communication with said at least one output port; and a dispense vial comprising:

a dispense vial container body including a body wall defining a vial cavity and an annular neck defining a vial aperture, said vial aperture in fluid communication with said vial cavity;

a container cap including a cap body, said container cap affixed to the neck of said container body so as to span said vial aperture, said cap body including opposed top and bottom surfaces and defining a fluid aperture extending through cap body and opening on each of said first and second surfaces;

an elongate vial conduit comprising a vial conduit body having a first end defining a first aperture, a second end defining a second aperture, and an elongate tubular vial conduit body extending therebetween, said tubular vial conduit body defining an elongate fluid passageway extending in fluid communication between said first and second apertures of said vial conduit body, said second end of a fluid conduit body in fluid-tight connection with said fluid aperture of said cap body so that said fluid passageway is in fluid communication with said vial cavity;

first valve member supported at the first end of said vial conduit; and a second valve member removably attached to said first valve member at an opposing end of said first valve member, wherein said second valve member is pressure-activated and biased to a normally-closed position and open under fluid pressure, said first and second valve member are adjustable between a first orientation in which the first valve member is in a closed position ensuring fluid isolation of said vial cavity and a second orientation in which the first valve member is in an open position to place said vial cavity in open fluid communication with an inlet port of said second valve member.

13. A dispense cassette of claim 12, wherein said cap body further defines a vent aperture and a flow aperture extending in open fluid communication between said top and bottom surfaces in registry with said vial aperture, and wherein said cap body further comprises a gas vent affixed to said cap body, said gas vent including a porous filter media defining a filter pores extending through said filter media, said filter pores in fluid communication with said vent aperture of said cap body.

14. A dispense cassette of claim 13, further comprising: An elongate vial needle having a first end defining a first opening, a second end defining a second opening, and an elongate tubular needle body extending therebetween, said needle body defining an elongate needle passageway extending in fluid communication between said first and second opening of said needle, said needle passageway in fluid communication with said fluid passageway of said vial conduit.

15. A dispense cassette of claim 12, wherein the cassette manifold further comprising:

an elongate filtrate conduit comprising a conduit body having a first end defining a first aperture, a second end defining a second aperture, and an elongate tubular body extending therebetween, said tubular body defining an elongate filtrate passageway extending in fluid communication between said first and second apertures, wherein said first end is connected to said manifold body such that said first aperture is in fluid communication with said at least one output port.

* * * * *